US006497125B1

(12) United States Patent
Necchi

(10) Patent No.: US 6,497,125 B1
(45) Date of Patent: Dec. 24, 2002

(54) ANTI-THEFT CASE, PARTICULARLY FOR COMPACT DISKS, VIDEO CASSETTES, MUSIC ASSETTES AND THE LIKE

(76) Inventor: Pietro Necchi, Via Dante, 7, I-15013, Borgoratto (IT)

( * ) Notice: Subject to any disclaimer, the term of this patent is extended or adjusted under 35 U.S.C. 154(b) by 0 days.

(21) Appl. No.: 09/582,639

(22) PCT Filed: Jan. 15, 1999

(86) PCT No.: PCT/IT99/00004

§ 371 (c)(1),
(2), (4) Date: Jul. 28, 2000

(87) PCT Pub. No.: WO99/39068

PCT Pub. Date: Aug. 5, 1999

(30) Foreign Application Priority Data

Jan. 29, 1998 (IT) ..... TO980017 U
Feb. 5, 1998 (IT) ..... TO98A0094

(51) Int. Cl.[7] ..... B65D 85/67
(52) U.S. Cl. ..... 70/57.1; 206/307
(58) Field of Search ..... 70/57.1, 58, 63; 206/307, 308.1, 308.2, 387.1, 387.11

(56) References Cited

U.S. PATENT DOCUMENTS 2,293,942 A * 8/1942 Klahn
4,512,470 A * 4/1985 Sieben ..... 206/387.1
4,540,090 A * 9/1985 Gelardi et al. ..... 206/387.1
4,928,825 A * 5/1990 Hehn ..... 206/387.13
5,011,010 A * 4/1991 Francis et al. ..... 206/307
5,158,176 A * 10/1992 Wolf ..... 206/751
5,168,998 A * 12/1992 Satoh et al. ..... 206/387.1
5,205,401 A * 4/1993 Weisburn et al. ..... 206/1.5
5,211,283 A * 5/1993 Weisburn et al. ..... 206/1.5
5,297,672 A * 3/1994 MacTavish ..... 206/308.2
5,323,904 A * 6/1994 Katagiri et al. ..... 206/387.1
5,349,331 A * 9/1994 Sieber et al. ..... 206/309
5,413,219 A * 5/1995 Yu ..... 206/387.1
5,429,237 A * 7/1995 Morita ..... 206/387.13
5,443,159 A * 8/1995 Cheng ..... 206/387.1
5,499,714 A * 3/1996 Konno ..... 206/387.13
5,503,272 A * 4/1996 Morita ..... 206/387.1
5,524,752 A * 6/1996 Mazzucchelli ..... 206/308.2
5,533,619 A * 7/1996 Ziegler ..... 206/387.12
5,690,224 A * 11/1997 Koizumi ..... 206/387.1
5,718,332 A * 2/1998 Tachibana ..... 206/1.5
5,782,352 A * 7/1998 Senda ..... 206/308.3
5,797,487 A * 8/1998 Young ..... 206/307
5,896,866 A * 4/1999 Quennessen ..... 132/293
5,899,327 A * 5/1999 Sykes ..... 206/307.1
5,904,246 A * 5/1999 Weisburn et al. ..... 206/1.5
6,009,999 A * 1/2000 Morita et al. ..... 206/387.13
6,021,784 A * 2/2000 Yuhaea ..... 132/293

* cited by examiner

*Primary Examiner*—William A. Cuchlinski, Jr.
*Assistant Examiner*—Olga Hernandez
(74) *Attorney, Agent, or Firm*—Oblon, Spivak, McClelland, Maier & Neustadt, P.C.

(57) ABSTRACT

An anti-theft case for products, particularly for compact disks, video cassettes, music cassettes, and the like. The anti-theft case is adapted to occupy as little space as possible during product exposition and to prevent unwanted twisting forces against it. The case is equipped with a locking and unlocking device completely inserted inside the case and cooperating with the case and a moving abutment member to lock the product into the case. The case is further equipped with anti-twisting structure to prevent unwanted extraction of the products by violent and abrupt torsion forces.

10 Claims, 11 Drawing Sheets

ANTI-THEFT CASE, PARTICULARLY FOR COMPACT DISKS, VIDEO CASSETTES, MUSIC ASSETTES AND THE LIKE

BACKGROUND OF THE INVENTION

1. Field of the Invention

The present invention refers to an improved anti-theft case, particularly for compact disks, videocassettes, musicassettes and the like, that is of use for these objects when they are exposed and marketed in different types of shops.

2. Discussion of the Background

Different types of anti-theft cases are known in the art, the most relevant one for the present Application being that disclosed in document EP-A0402822, assigned to the same Applicant, that is the preamble of Claim 1. Such anti-theft case is characterized by the following features:

- it is composed of a box shaped substantially as a parallelepiped and equipped with an insertion window for a cassette next to at least one of its faces;
- this window leaves at least two wall bands next to two opposite sides of the face;
- the length of the box room, along the cassette insertion direction, that is between such two sides, is greater than the length of the cassette itself;
- a moving abutment member cooperating with a cassette head is provided inside the box in the area of one of the two wall bands: this abutment member can alternatively assume an active abutment position, advanced towards the cassette, and a passive retired position from the cassette; and
- a locking and unlocking device to take the moving abutment member from its active abutment position to its passive retired position.

This prior art anti-theft case has been a relevant step forward in the art, providing a simple solution for final users with a strong anti-theft capacity. However, for current user needs, this case shows the following fields of improvement:

a) users of this type of anti-theft cases, that is music shops, supermarkets, ipermarkets, etc., need to show to the people purchasing their products the maximum possible number of products, and therefore require that anti-theft cases occupy as fewer space as possible: in this respect, the appendix for the locking and unlocking device of this case is an increase in overall dimensions in some cases where it is possible to do without it;

b) in case of attempted thefts, through a particularly strong blow given to the container for the locking and unlocking device, this latter one can be made jump off its seat inside the moving abutment member and then the spring pushing force with which such abutment member is equipped is enough to make it come out of the case, making the article inside it accessible to thieves;

c) particularly in case of attempted thefts in anti-theft cases containing videocassettes, the case can be further subjected to a torsion force, that sometimes succeeds in breaking the case, or that it is enough to make the article therein come out.

Document WO 97/05113 (Necchi Pietro) deals with a reduced-encumbrance anti-theft case, whose main object is however that of being able to allow stacking one empty case above the other in order to occupy less space during shipment and storage of huge amounts of cassettes, and not during exposition thereof when cases are with a product.

SUMMARY OF THE INVENTION

Object of the present invention is solving the above prior-art problems by providing an improved anti-theft case that, in addition to providing a case that is practical to use and substantially protects the articles therein, has an extremely compact outside shape, that is identical to the one of the product contained therein, so that the product-case assembly is almost unique and has final overall sizes that are reduced to a minimum, these requirement being mandatory for a correct operation.

Another object of the present invention is providing an improved anti-theft cases whose closure means are particularly strong and adapted to prevent any violent action from succeeding in removing the articles contained therein.

The above and other objects and advantages of the invention, as will appear from the following description, are obtained by an anti-theft case as claimed in Claims 1 and 7. Preferred embodiments and non-trivial variations of the present invention are claimed in the dependent Claims.

BRIEF DESCRIPTION OF THE DRAWINGS

The present invention will be better described by some preferred embodiments thereof, given as a non-limiting example, with reference to the enclosed drawings, in which:

FIG. 24 is a detailed view of part of

FIG. 23 as regards cooperation between abutment member and case;

DESCRIPTION OF THE PREFERRED EMBODIMENTS

Figure 1:
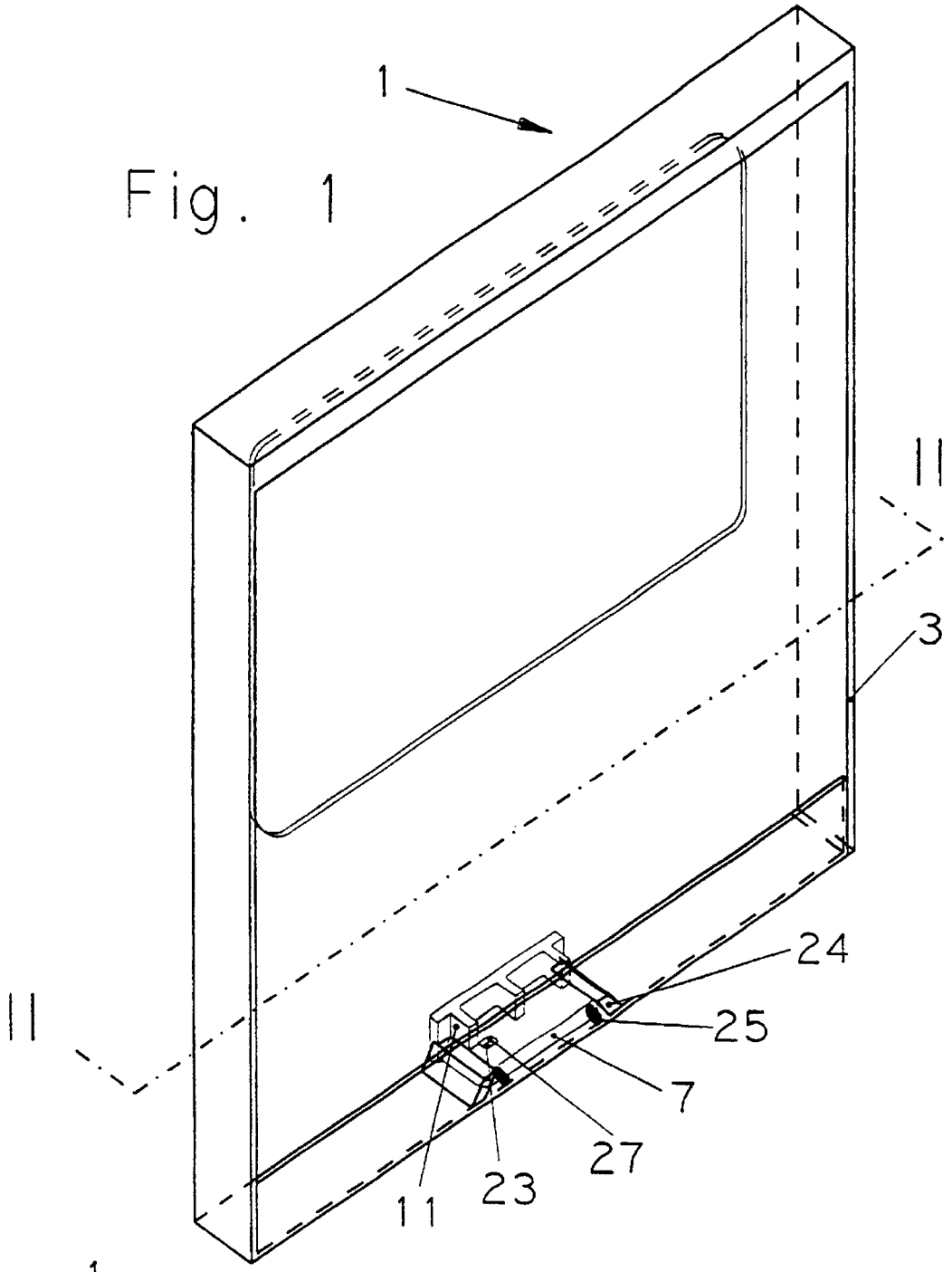
FIG. 1 is a perspective view of a first embodiment of the anti-theft case of the present invention used for compact disks.
Figure 2:
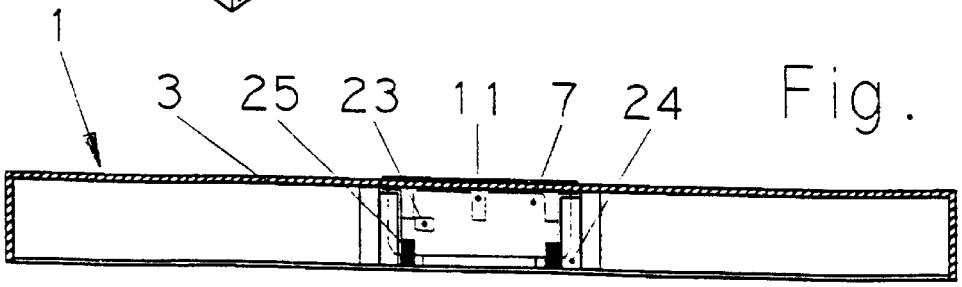
FIG. 2 is a top sectional view carried out along line II—II in FIG. 1.
Figure 3:
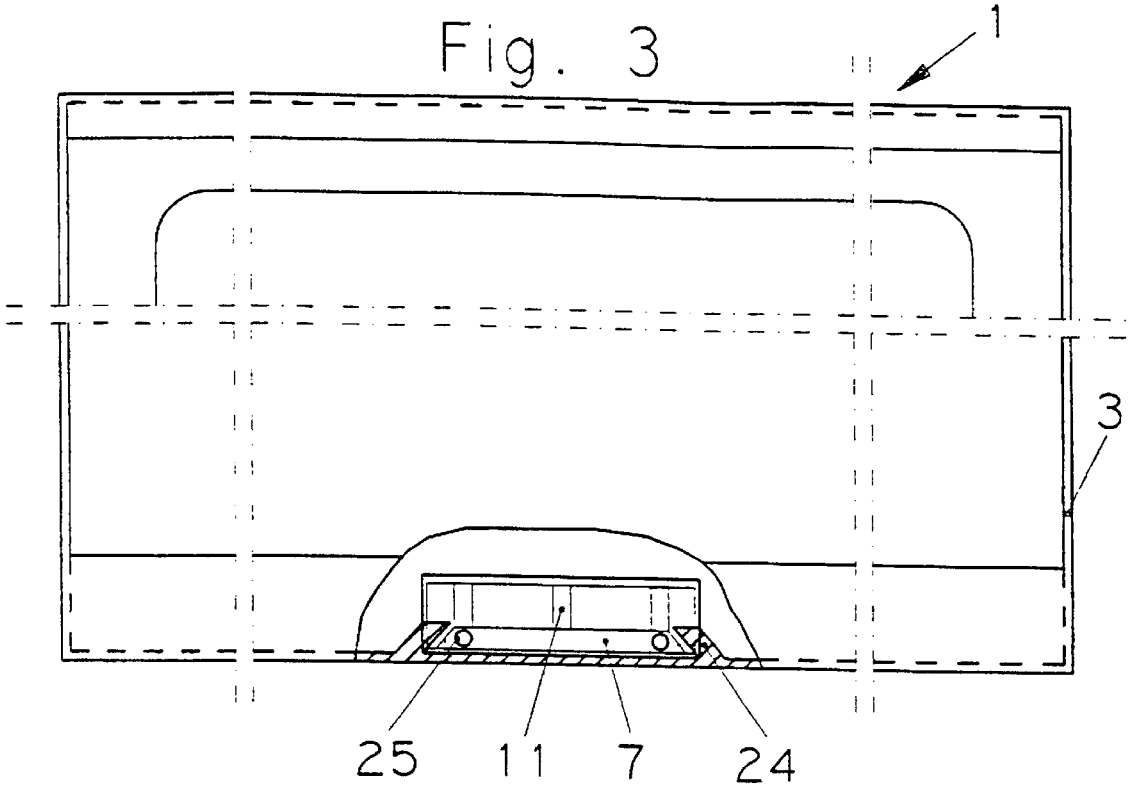
FIG. 3 is a side view of FIG. 1.
Figure 4:
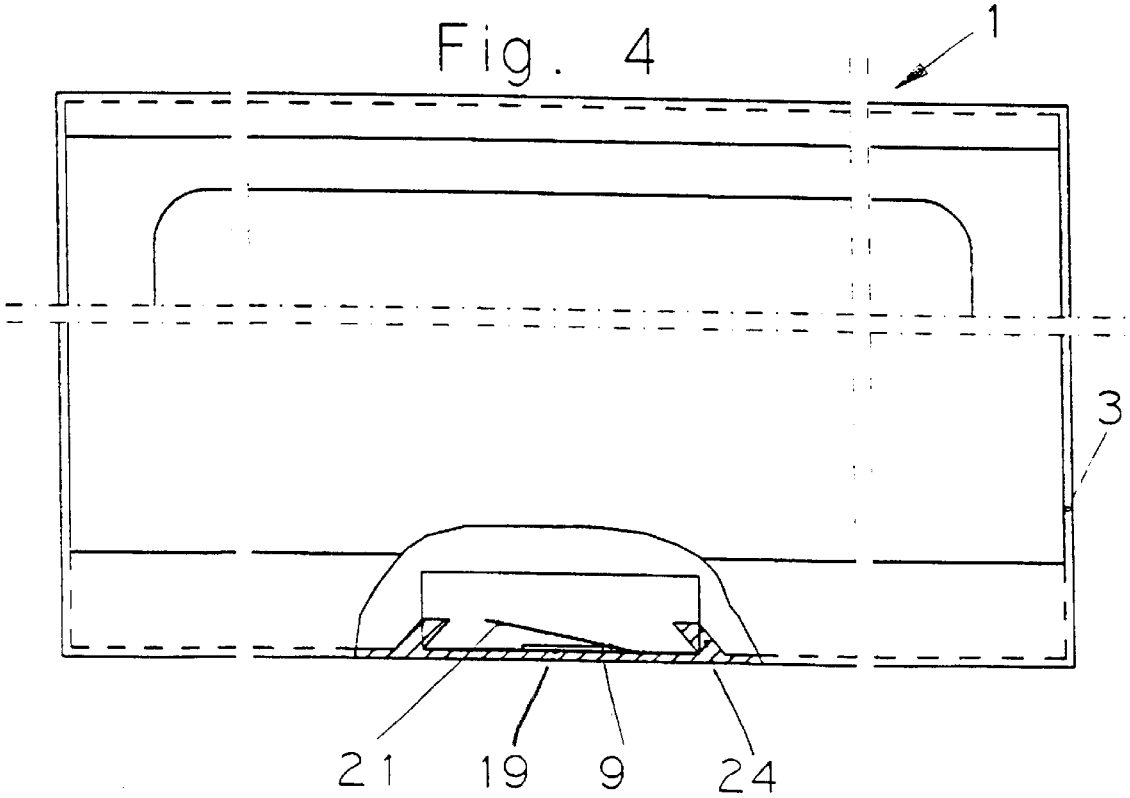
FIG. 4 is a side view similar to FIG. 3, but with the moving abutment member removed to better show the locking and unlocking device.
Figure 5:
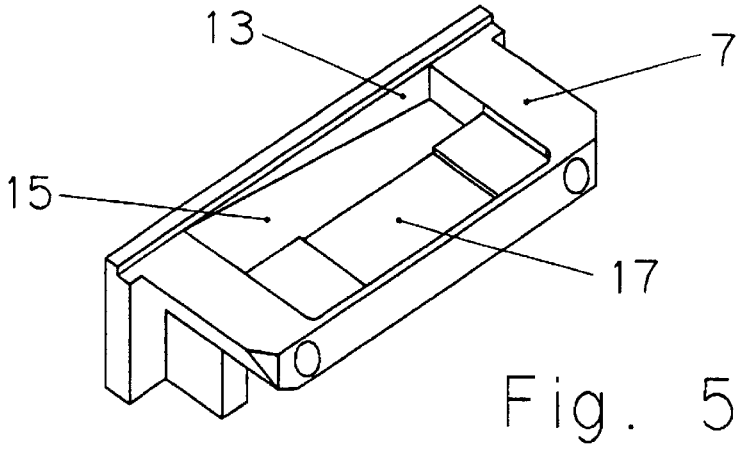
FIG. 5 is a bottom perspective view of the moving abutment member of the first embodiment of the invention.
Figure 7:
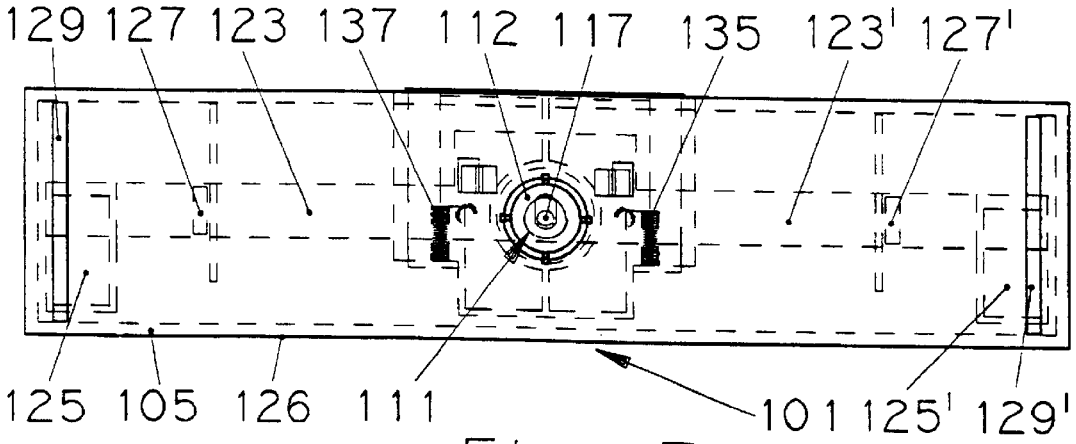
FIG. 7 is a bottom view of the case in FIG. 6.
Figure 8:
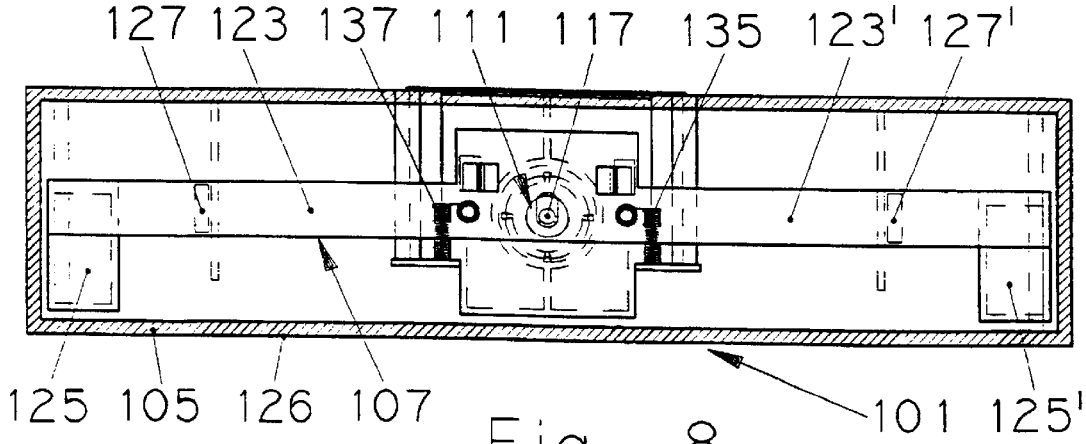
FIG. 8 is a top sectional view of the case in FIG. 6.
Figure 6:
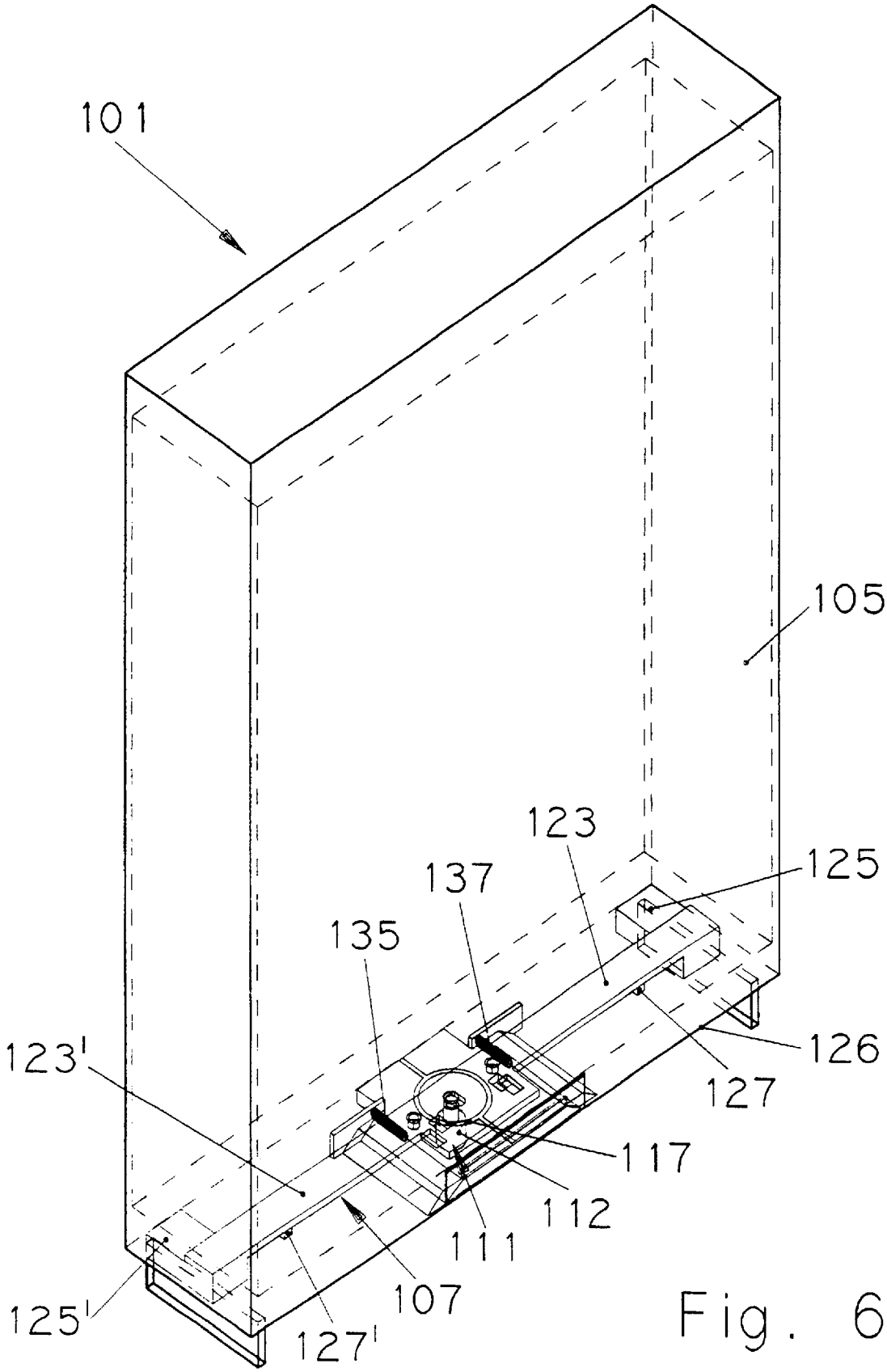
FIG. 6 is a perspective view of a second embodiment of the anti-theft case of the present invention used for videocassettes.
Figure 9:
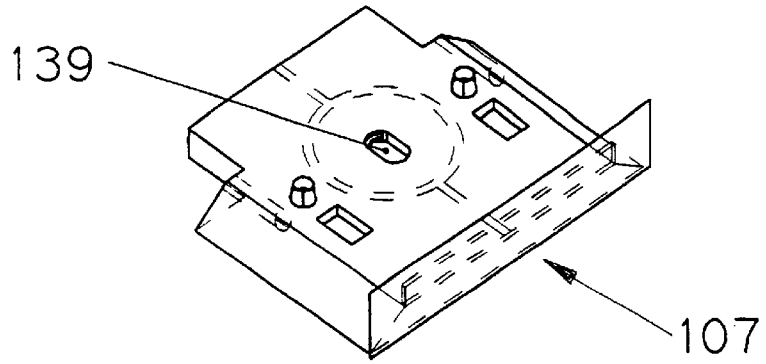
FIG. 9 is a side view of the moving abutment member of the second embodiment in FIG. 6.

With reference to FIGS. 1 to 5, a first embodiment of the anti-theft case of the present invention will be described. The improved anti-theft case 1 of this first embodiment is composed in a known way of a box 3, substantially shaped as a parallelepiped, whose sizes are such as to contain the product to be protected (not shown), such as a compact disk (as in the preferred embodiment shown), a videocassette, a musicassette or the like. The product is inserted into the case 1 in a known way, by transversally inclining it and taking one of its sides in abutment with the corresponding wall of the case 1. The insertion is completed then by sliding the product inside and releasing a moving abutment member 7, that penetrates inside the case 1 and, by limiting the internal space, prevents removing the product therefrom. In order to be able to take the moving abutment member 7 from its inactive "opening" position of the case 1 to its active engagement position with the product to prevent its removal from case 1, various known magnetic means (not shown) are provided that release a locking and unlocking device 9 cooperating with the above abutment member 7.

All the above mentioned components are well known in the art, for example from the above document EP-A-0 402 822, and therefore their detailed description will be ommitted as regards composing parts and operation thereof.

In order to realize the arrangement of the case 1 according to the invention, in such a way as to allow a more efficient use due to its reduced outside overall dimensions, it has been necessary to deeply modify the configuration of the moving abutment member 7 and the locking and unlocking device 9, leaving unaltered their mutual operation also as regards the case 1 and the product contained therein.

For this purpose, the moving abutment member 7 has been modified by inserting therein a plurality of ribs 11 (in the embodiment shown the ribs 11 are three) that abut against one side of the product and allow a "lateral" closure of the product itself inside the case 1, differently frrom prior art "front" cases where product closure occurred from below. Moreover, the ribs 11 have the purpose of strenghtening the moving abutment member 7 thereby preventing a twisting of the case 1 in an attempt of fraudulently extract the product therefrom.

The moving abutment member 7 has then been modified by obtaining thereinto a suitable seat 13 (that is clearly seen in FIG. 5) to house the locking and unlocking device 9, that is shaped similarly to seat 13. Seat 13, in the first preferred embodiment shown, is shaped substantially as a "T" and shows for this purpose an elongated rectangular part 15 shaped as an inclined plane descending from inside the moving abutment member 7 towards the lower wall of the case 1, and a shorter rectangular part 17 (the "shank" of the T) adapted to house a corresponding tongue 19 of the locking and unlocking device 9 in order to restrain the device 9 itself.

The locking and unlocking device 9 has been modified by realizing it with a resilient metallic material and in a thin lamellar shape, whose thickness is enough to allow an efficient locking of the moving abutment member 7. The lamellar material is further equipped with a resiliency that is enough to realize the functionalities of a spring, and moreover, being it metallic, it can be attracted by known magnetic means (not shown) located outside the case 1.

The locking and unlocking device 9 is thereby shaped in order to obtain thereinto a tongue 21 that, in its rest position, tends to project and be placed upwards (as seen by the viewer of the figures) and therefore to perfectly adhere to the inclined plane of the elongated rectangular part 15 of the moving abutment member 7. In this position, that corresponds to the closure of case 1, the moving abutment member 7 is completely inside the case 1 and cannot be removed therefrom for the locking engagement of tongue 21 with seat 13.

The locking and unlocking device 9 is further shaped in order to obtain thereinto a tooth 23 adapted to be inserted into and cooperate with the short rectangular part 17 of the abutment member 7, in order to hold the member 7 itself inside the case 1 even when it is in its opening position. For this purpose, the box 3 is also equipped with two inclined projections 24 that realize a dovetail-shaped opening, inside which the moving abutment member 7 is located, the moving abutment member 7 being also suitably shaped as a dovetail, to prevent its upward removal in the operating position.

In order to open the case 1, it is then necessary to place it onto the above magnetic means, which attract the tongue 21 downwards, taking it to a parallel position with respect to the bottom of the case 1 and freeing thereby the abutment member 7. In order to be able to proceed to open the abutment member 7, it is however necessary to perform a further operation, provided to guarantee a better anti-theft efficiency of the case 1 even against violent stealing attempts. It will in fact be necessary to press the abutment member 7 towards the inside of the case 1 by exerting a force that is contrary to that of at least one (or better two) springs 25 and unhooking the teeth 23 of the opening 27 obtained in the case 1 from the side 17 of the seat 13. At that time, the springs 25 will push the moving abutment member 7 outside of the case 1 for the extent necessary to free the product therein to be inserted or removed.

The locking and unlocking device 9 can be realized in other shapes and arrangements apart from the one shown and described, obtaining the same functionalities. At the same time, both the moving abutment member 7 and the locking and unlocking device 9 can be placed in the case 1 on the opposite side with respect to the one shown herein, keeping unaltered their mutual operation, to allow a better protection against the most violent stealing attempts.

With reference to FIGS. 6 to 11, a second embodiment of the anti-theft case of the present invention will be described.

The case according to this second embodiment is shown in the version used to contain and protect videocassettes, but obviously, through the adequate dimensionings and adaptations, the case 101 can be applied to all the other types of articles mentioned, and other similar ones, without departing from the scope of the present invention.

The case 101 is substantially composed of a box 105 to contain the article (not shown) to be protected, and of a moving abutment member 107 suitable to cooperate, in a known way, with the product head when inserting it inside the box 105 in order to prevent its removal from the box 105. The anti-theft case 101 finally includes a locking and unlocking device 111 to take the moving abutment member 107 from its active position in which the product is unmovably inserted in the box 105 to its passive rest position in which the product is able to be removed from the box 105.

According to the second preferred embodiment of the invention, the locking and unlocking device 111 comprises a small cylinder 112 housed inside a container 113 that is outside the box 105 and is abutting against the bottom of the container 113 (with respect to the view in FIG. 6) through resilient means 115, for example a common spring. In its upper part (always with respect to FIG. 6) the locking and unlocking device 111 is composed of a further small cylinder 117 whose diameter is less than that of cylinder 112 and that is formed integrally with cylinder 112, or connected thereto for example through welding. Such small cylinder 117 has obtained therein a notch 119 suitable to cooperate, as clearly shown in FIG. 10, with the moving abutment member 107 to unmovably keep it into its closed position when it is contained inside such notch 119. There are further provided at least two resilient means 135, 137 that are adapted both to keep the moving abutment member 107 "restrained" inside the notch 119, when closing the case 101 (preventing the abutment member 107 from being opened through unwanted abrupt blows), and to push the abutment member 107 outside the case when unlocking, that is when the locking and unlocking device 111 is subjected to an attraction force downwards due to adequate magnetic means and the fingers of a hand are used to push the abutment member 107 outside the notch 119: in this way, the locking and unlocking device 111 is freed from its engagement with the moving abutment member 107 and is attracted downwards, in turn freeing the path for the abutment member 107 that is pushed outwards of the case 101 by the resilient means 135, 137, finally freeing the product inside the case 101, or allowing the insertion of a new product inside the case 101.

To complete the features of the anti-theft case 101 of the second embodiment of the invention, the moving abutment member 107 is equipped with a pair of arms 123, 123' that extend for the whole length of the side 125 of the box 105 in which the moving abutment member 107 is located. These arms 123, 123' are further equipped, at their distal ends from the abutment member 107, with abutment elements 125, 125' adapted to realize the reinforcement that prevents twisting of the case 101 by rotation, providing two abutment points inside it to support the product contained.

In the non-limiting embodiment shown, the abutment elements 125, 125' are shaped as a parallelepiped, and their action can be increased by using at least a rib 127, 127' located on each one of the arms 123, 123', that slidingly cooperates with a respective rib 129, 129' formed integrally with the body of box 105 of case 101.

In a known way, the anti-theft case of the present invention is then equipped with electronic devices (not shown) or the like, to signal the possible product theft; these signalling devices are usually located inside a housing (not shown) suitably obtained in a known way on one of the walls of the case.

According to a constructive variation of the second embodiment of the invention, the locking and unlocking device 111 can always be composed of a pair of small cylinders 112, 117, mutually joined, that cooperate with resilient means 115; in this case, however, the upper cylinder 117, whose diameter is less than that of the lower cylinder 112, has not a notch obtained therein. In this case, to avoid that abrupt and violent blows disengage the locking and unlocking device 111 from the moving abutment member 107, it is necessary to provide the two resilient means 135, 137 in such a way that they exert a greater pushing force on the abutment member 107: this pushing force will be enough to prevent opening the case 101 through abrupt blows.

Figure 10:
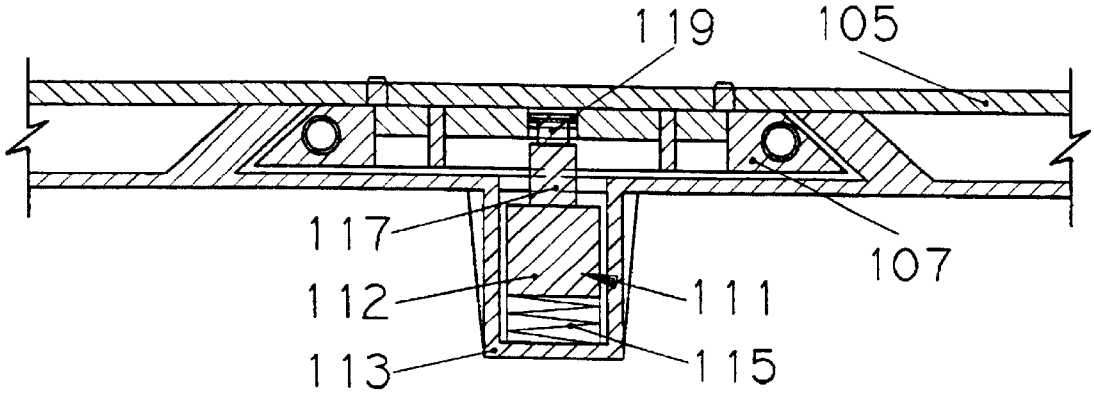
FIG. 10 is a sectional view that shows the cooperation between moving abutment member and locking and unlocking device when closing the case in FIG. 6.
Figure 11:
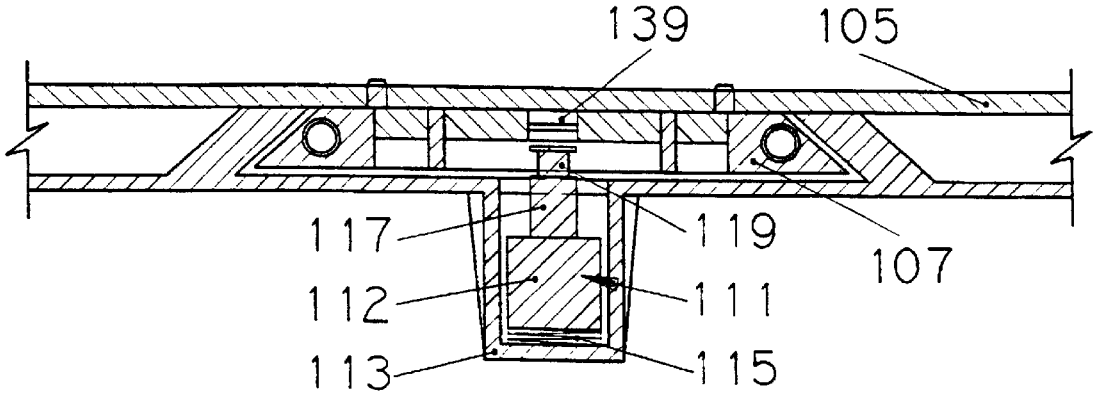
FIG. 11 is a sectional view that shows the cooperation between moving abutment member and locking and unlocking device when opening the case in FIG. 6.

With reference now to FIGS. 10 and 11, the operating procedure of the anti-theft case 101 of the invention will be described. After having unlocked the moving abutment member 107 by moving the locking and unlocking device 111 downwards (for example attracting it with a magnetic device like the ones found in supermarket cashier desks), the device 111 goes out of the hole 139 obtained in the abutment member 107 that is freed and slides vertically with respect to the drawing in FIG. 6.

To realize such displacement, however, due to the presence of the notch 119 or the resilient means 135, 137, the user will first have to exert a contrary pressure, that is exerted towards the inside of the case 101, in order to disengage the moving abutment member 107 from the notch 119 or to free it from the pushing foce of the resilient means 135, 137.

After having performed such push with the finger of a hand, the locking and unlocking device 111 is attracted downwards (with respect to FIG. 6) and the force of the resilient means 135, 137 pushes the moving abutment member 107 outside of the case 101, allowing to insert or remove the product from the case 101 itself, as shown in FIG. 11. By performing the reverse operations, the moving abutment member 107 is pushed inside the case 101 till the suitable hole obtained therein engages in a known way the locking and unlocking device 111, taking the case in the closing position shown in FIG. 10. In a known way, according to the type of article to be protected, the box 105 of the case 101 of this embodiment of the invention can be realized in different shapes, for example the one with a double box, that is better suitable to contain videocassettes, and another embodiment of which will be described below.

With reference to FIGS. 12 to 26, a third embodiment of the anti-theft case of the present invention will be described.

Figure 17:
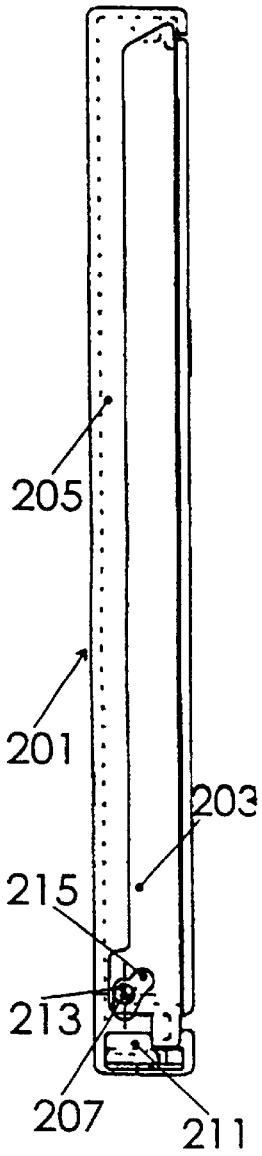
FIG. 17 is a side view of the case of the third embodiment when closed.
Figure 12:
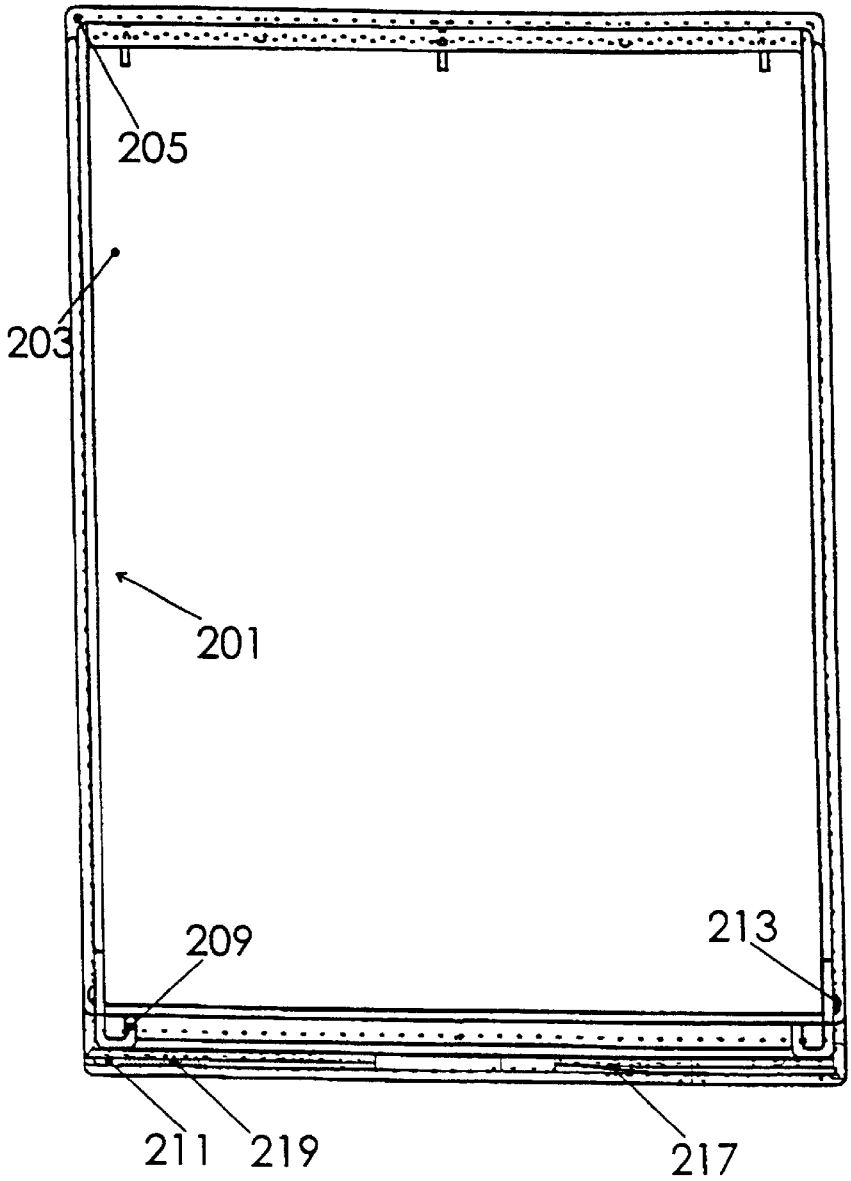
FIG. 12 is a front view of a third embodiment of the anti-theft case of the present invention used for videocassettes.
Figure 18:
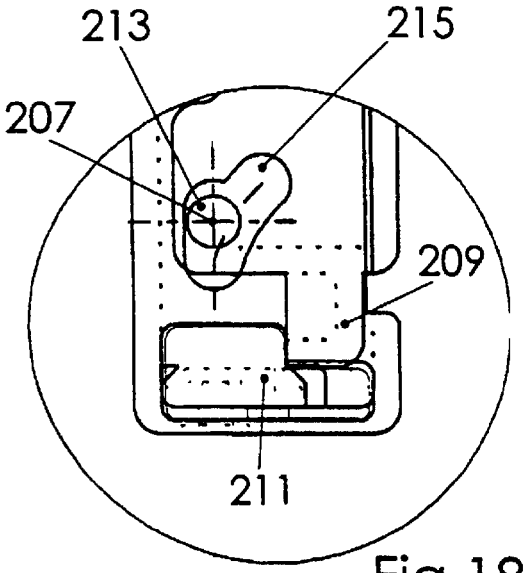
FIG. 18 is a detailed view of part of FIG. 17 as regards cooperation between abutment member and the two parts of the case.
Figure 14:
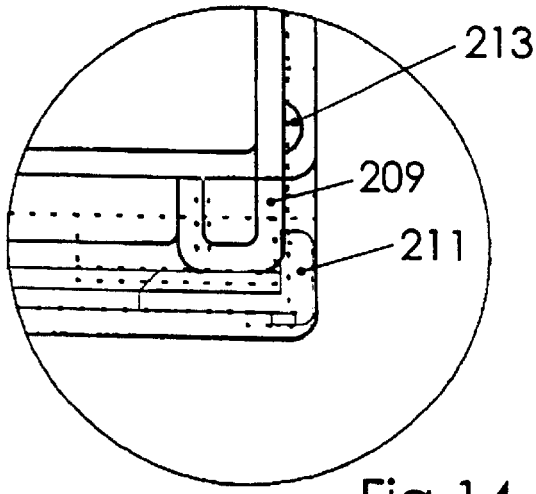
FIG. 14 is a detailed view of part of FIG. 12 as regards cooperation between abutment member and case during closure.
Figure 22:
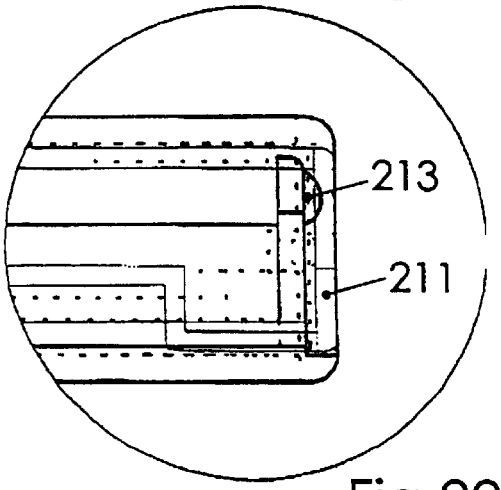
FIG. 22 is a detailed view of part of FIG. 21 as regards cooperation between abutment member and case.
Figure 13:
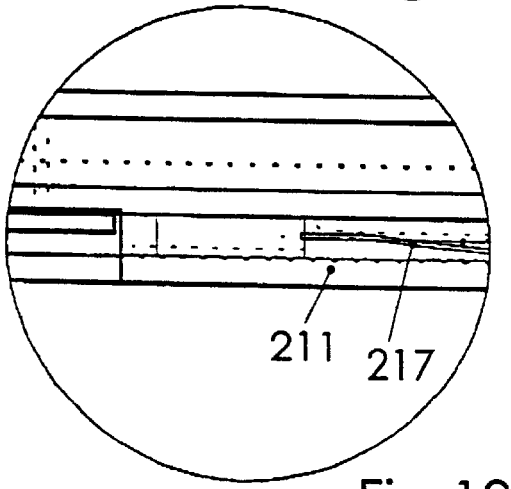
FIG. 13 is a detailed view of part of FIG. 12 as regards the locking and unlocking device.
Figure 20:
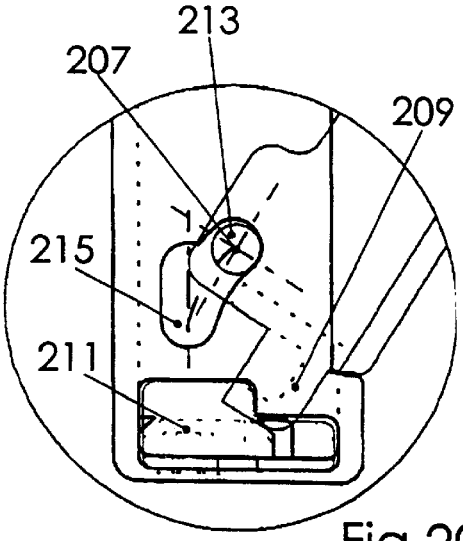
FIG. 20 is a detailed view of part of FIG. 19 as regards cooperation between abutment member and the two parts of the case.
Figure 15:
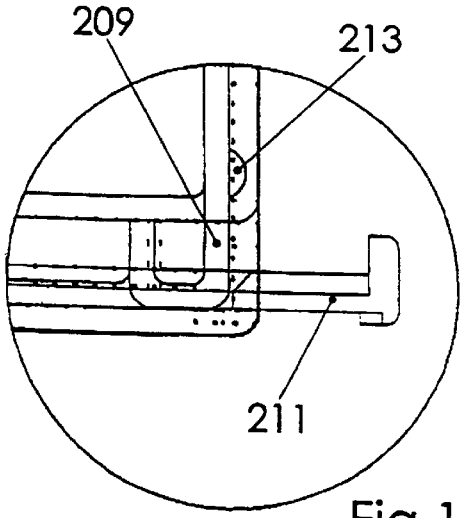
FIG. 15 is a front view similar to FIG. 14 but with the abutment member in its opened position.
Figure 24:
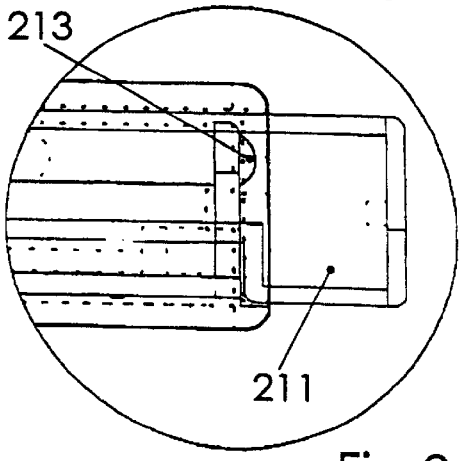
Figure 16:
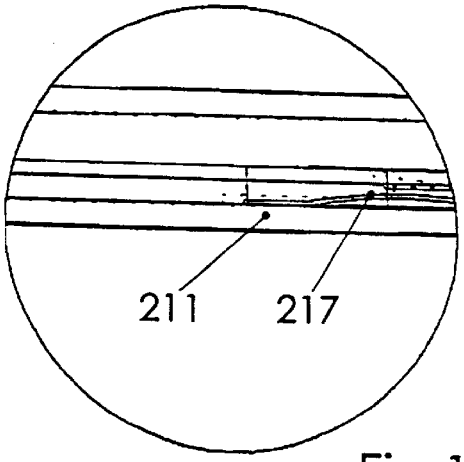
FIG. 16 is a detailed view of part of FIG. 12 as regards cooperation between abutment member and case when opening.
Figure 19:
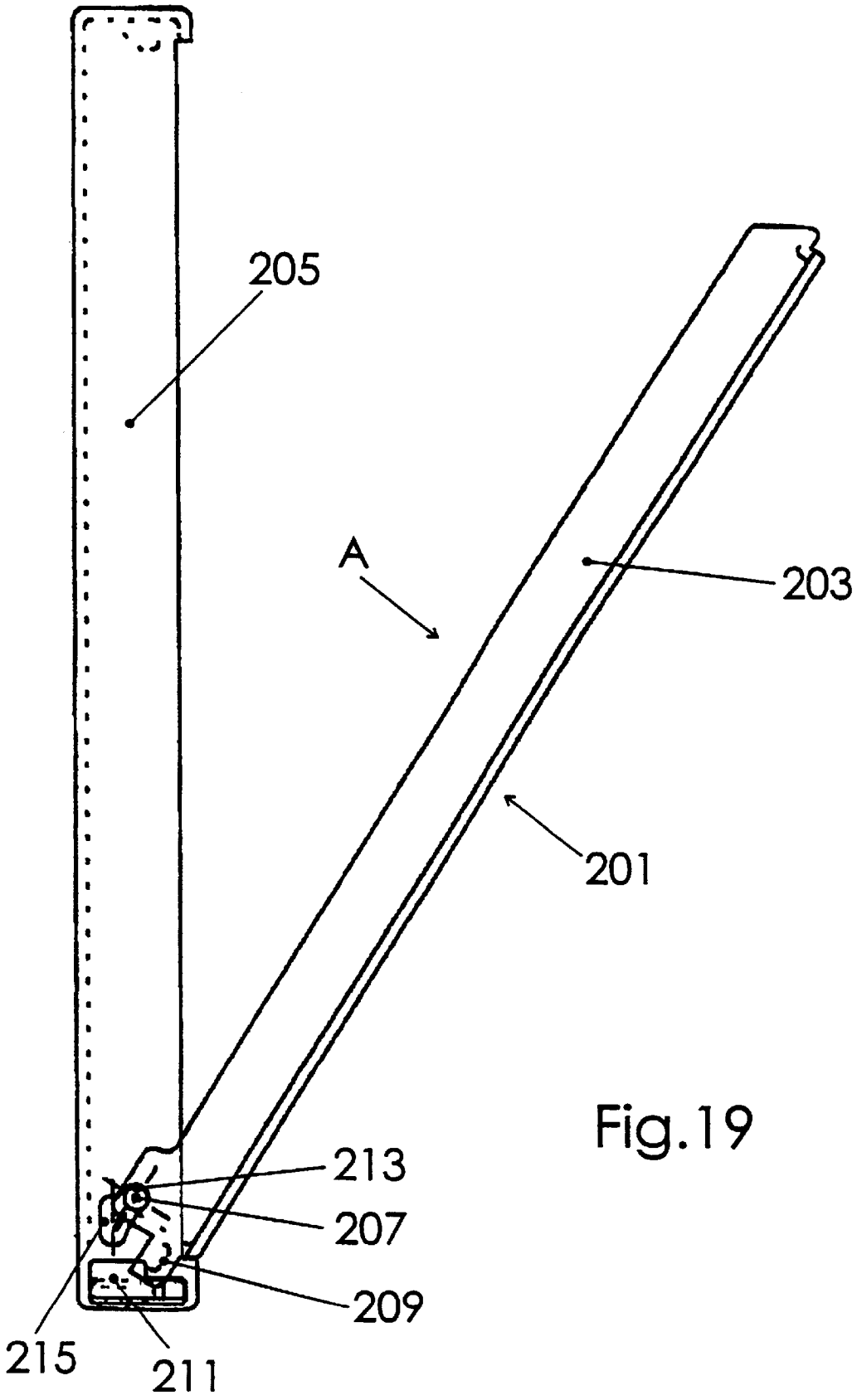
FIG. 19 is a side view of the case of the third embodiment when opened.
Figure 21:
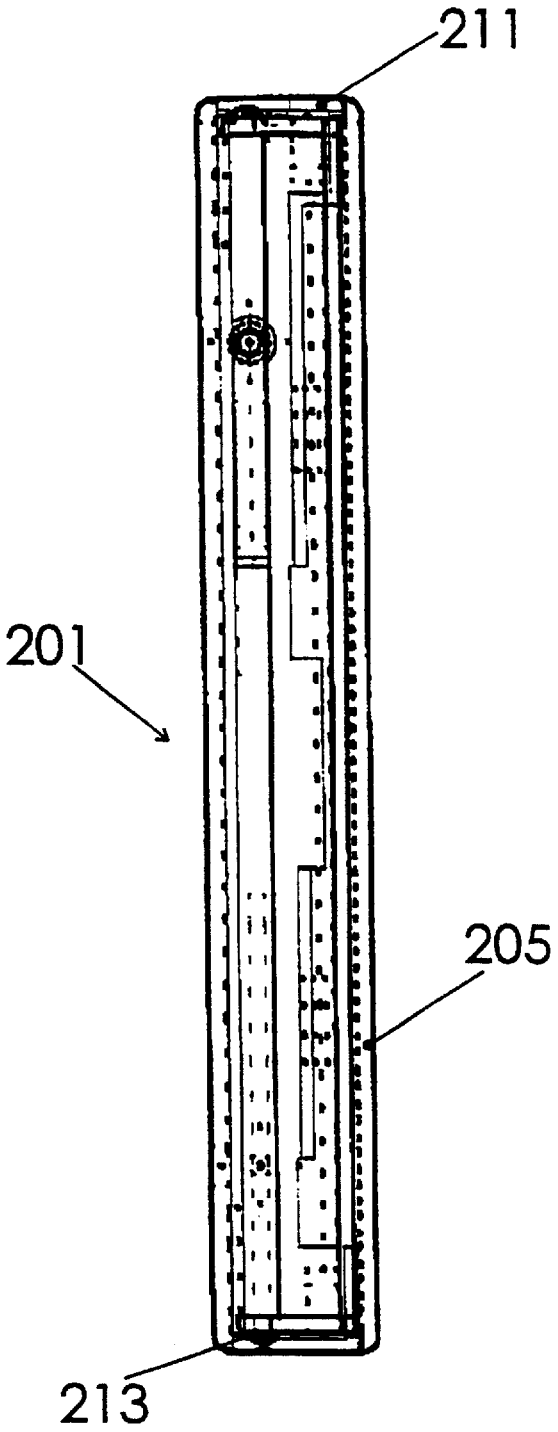
FIG. 21 is a bottom view of the third embodiment of the case when closed.
Figure 23:
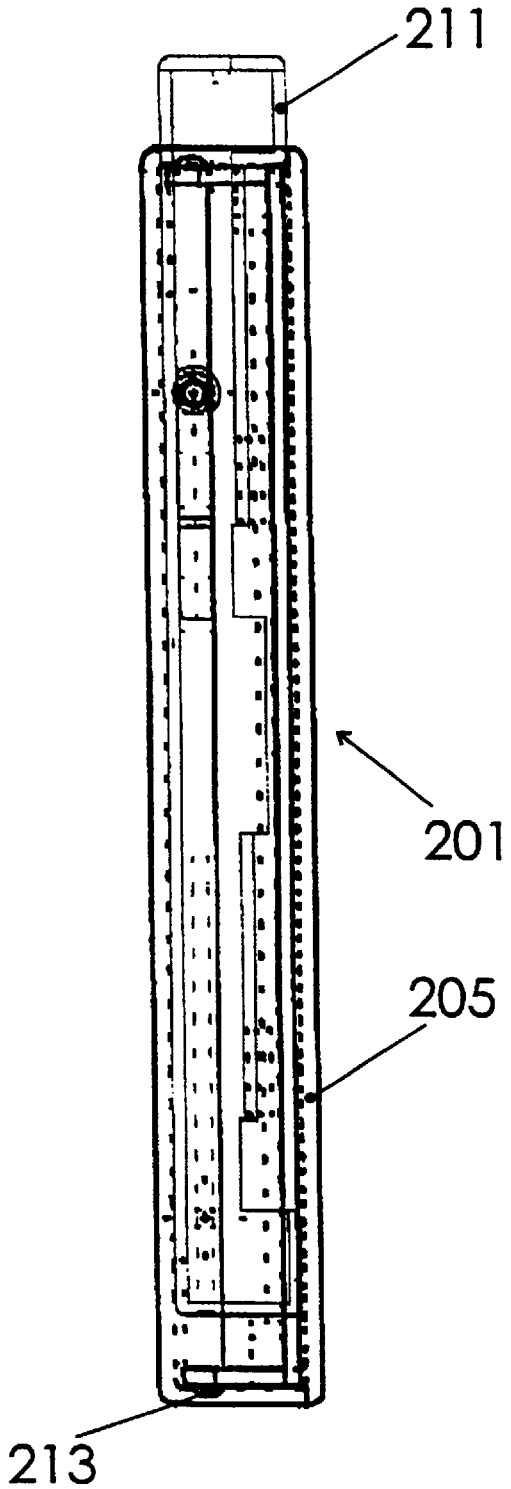
FIG. 23 is a bottom view of the third embodiment of the case when opened.
Figure 26:
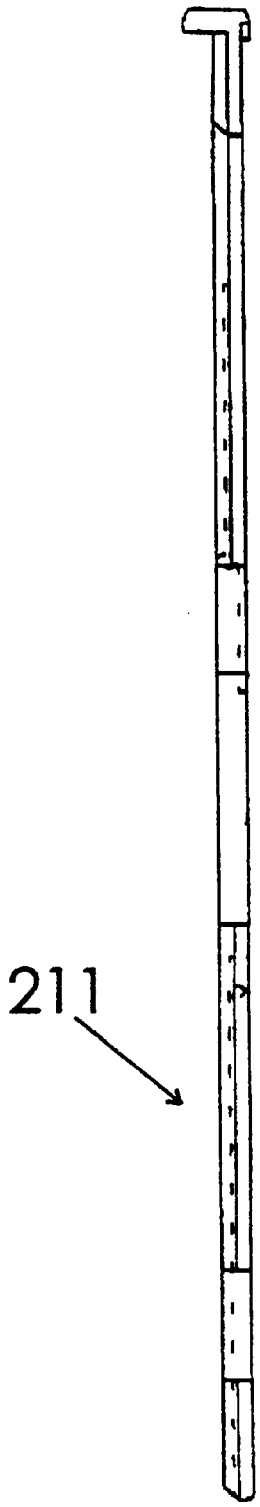
FIG. 26 is a top view of the abutment member of FIG. 25.
Figure 25:
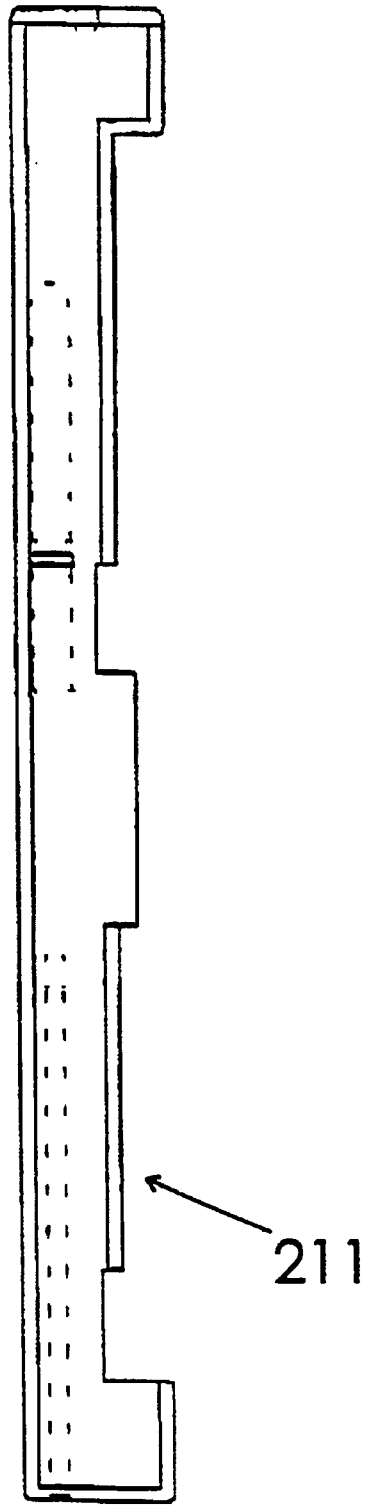
FIG. 25 is a side view of the moving abutment member for this embodiment.

The case 201 shown is adapted and best suited to contain videocassettes. It is substantially composed of a first semi-case 203 adapted to receive a videocassette container (not shown) and a second semi-case 205, rotatingly connected in point 207 to the first semi-case 203. The second semi-case 205 is adapted to contain therein the first semi-case 203 embracing and enclosing it after having received the videocassette container. The first semi-case 203 is equipped and supported by two foot 209, that both support the semi-case 203 into the second semi-case 205, and are used to prevent unwanted opening of the case 201, as clearly shown in FIGS. 17 to 20. Here, FIGS. 17 and 18 show the opening position of case 201, while FIGS. 19 and 20 show the closing position thereof. As can be seen, when closed (FIG. 17, 18), the foot 209 rests against the moving abutment member 211 and the semi-case 203 remains closed inside the semi-case 205. When opening, the semi-case 203 slides with its protrusion 213 inside the recess 215 of the second semi-case 205 and opens outwards (arrow A in FIG. 19): in order to be free to rotate outwards, the foot 209 of the semi-case 203 must be disengaged from the moving abutment member 211 that projects outwards as shown in FIGS. 15, 23 and 24. To enable the abutment member 211 to become disengaged and project outwards, there is provided a locking and unlocking device 217 (here realized as a small plane resilient member) that is normally in the upward position shown in FIG. 13, thereby locking the abutment member 211 in its closed position inside the case 201. When subject to the action of means (not shown) providing an attractive force downwards, like those commonly found in the cashier's counters in supermarkets, the device 217 is attracted downwards as shown in FIG. 16 and frees the abutment member 211 to be pushed out of the case 201 by the force exterted by a spring 219 placed inside the case 201; the abutment member 211 is prevented from completely going out of the case 201 by its own shape and by its connection to the spring 219: they both function as restraining means allowing the member 211 to move only for a limited outwards length. Another function of the foot 209 is also here to provide a lateral reinforcement, thereby preventing an unwanted removal of the product from the anti-theft case 201 by violently and abruptly twisting the case 201 itself along its lateral sides. Therefore, as a skilled person can easily derive by reading the above description together with the drawings, the three embodiments of the invention represent a common way of operating the inventive anti-theft case, where the opening and closing positions are reached by the mutual engagement and disengagement between abutment member and locking and unlocking device, in cooperation with the structure of the case and using external attracting means to enable or disable such opening and closing positions. For example, an anti-theft case for compact disks can be provided (not shown), where the abutment member is as long as one side of the case (as in the third embodiment shown here for videocassettes) and is equipped at both its ends with anti-twisting means in the form of internal projections or foot that abut against a side of the compact disk to keep it inside the case; the abutment member, when opening, slides outwards (as in the third embodiment here) and resiliently disengages the compact disk by using, for example, an hole in one side of the case, while, when closing, helps the disk being pushed inside the anti-theft case. In this example the locking and unlocking device is resilient and has a lamellar shape, like in the first embodiment shown here.

What is claimed is:

1. Anti-theft case comprising:

a box having a top surface, a bottom surface, and two pairs of parallel walls having lengths and widths appropriate to secure a product;

an abutment member mounted to said box to secure said product in the box when the abutment member is in an active position, the abutment member having a seat and being movable to an inactive position;

a resilient means for pushing said abutment member from said active position to said inactive position;

teeth cooperable with said abutment member to prevent said resilient means from pushing said abutment member from said active position to said inactive position; and a lamellar locking and unlocking device configured to selectively lock said moving abutment member in said active position and to unlock said abutment member from said active position when said teeth are detached from said abutment member.

2. Anti-theft case according to claim 1, wherein said abutment member comprises ribs configured to prevent twisting of said box.

3. Anti-theft case according to claim 1, wherein said seat comprises a housing configured to house a tongue of said locking and unlocking device.

4. Anti-theft case according to claim 3, wherein said box comprises two inclined projections defining a dovetail-shaped opening configured to house said abutment member.

5. Anti-theft case comprising:

a box having a top surface, a bottom surface and two pairs of parallel walls, each having a length and width appropriate to secure a predetermined product inside said box;

an abutment member, which is substantially T-shaped, comprising a center portion and two arms substantially extending along one of said walls, configured to occupy an active position and an inactive position;

resilient means configured to push said abutment member from said active position to said inactive position;

a locking and unlocking device comprising a notch configured to prevent said resilient means from pushing said abutment member towards said inactive position by engaging with said abutment member, said locking and unlocking device configured to lock said abutment member in said active position or, when said notch is not engaged with said abutment member, to unlock said abutment member such that said resilient means can push said abutment member towards said inactive position, wherein:

said abutment member secures said product within said box in said active position and leaves said product unsecured by said locking and unlocking device in said inactive position.

6. Anti-theft case according to claim 5, wherein said arms of said abutment member comprise abutment elements configured to prevent twisting of said box.

7. Anti-theft case according to claim 5, wherein said abutment elements are substantially rectangular.

8. Anti-theft case according to claim 5, wherein said arms comprise at least one reinforcing rib configured to cooperate with a corresponding rib formed in said box.

9. An anti-theft case according to claim 5, wherein said locking and unlocking device comprises a first cylinder housed outside said box, and a second cylinder, wherein:

said second cylinder has a larger diameter than said first cylinder.

10. An anti-theft case according to claim 1, wherein said box contains electronic means for signaling an attempted theft of said product.

* * * * *

UNITED STATES PATENT AND TRADEMARK OFFICE

CERTIFICATE OF CORRECTION

PATENT NO. : 6,497,125 B1
DATED : December 24, 2002
INVENTOR(S) : Necchi

It is certified that error appears in the above-identified patent and that said Letters Patent is hereby corrected as shown below:

Title page, Item [54] and Column 1, lines 1-3,
Should read:
-- [54] ANTI-THEFT CASE, PARTICULARLY FOR COMPACT DISKS, VIDEO CASSETTES, MUSIC CASSETTES AND THE LIKE --

Signed and Sealed this

Twentieth Day of May, 2003

JAMES E. ROGAN
*Director of the United States Patent and Trademark Office*